United States Patent [19]

Di Maio

[11] 4,132,042

[45] Jan. 2, 1979

[54] DOOR STRUCTURE AND METHOD FOR FORMING SUCH STRUCTURE

[76] Inventor: Vincent Di Maio, 4037 Lancelot Rd., Toledo, Ohio 43623

[21] Appl. No.: 869,384

[22] Filed: Jan. 13, 1978

[51] Int. Cl.[2] ..... E04B 2/28; E04C 2/32

[52] U.S. Cl. ..... 52/309.1; 49/501; 52/800; 428/116; 52/809

[58] Field of Search ..... 52/615, 309.1, 309.13, 52/309.15, 625, 629; 49/501; 428/116

[56] References Cited

U.S. PATENT DOCUMENTS

| | | | |
|---|---|---|---|
| 2,849,758 | 9/1958 | Plumley et al. | 52/309.15 |
| 3,227,601 | 1/1966 | Crosby | 428/116 X |
| 3,299,595 | 1/1967 | Munk | 52/309.13 |
| 3,423,878 | 1/1969 | Kimmel | 49/501 |
| 3,512,304 | 5/1970 | Meuret | 49/501 |
| 3,703,422 | 11/1972 | Yashino | 428/116 X |
| 3,753,843 | 8/1973 | Hutchison | 52/615 |
| 3,837,989 | 9/1974 | McCoy | 428/116 |
| 3,895,152 | 7/1975 | Carlson et al. | 52/615 |
| 4,064,655 | 12/1977 | Weyant | 49/501 |

FOREIGN PATENT DOCUMENTS

| | | | |
|---|---|---|---|
| 2005436 | 8/1971 | Fed. Rep. of Germany | 49/501 |
| 1269244 | 4/1972 | United Kingdom | 428/116 |

*Primary Examiner*—J. Karl Bell
*Attorney, Agent, or Firm*—Oliver E. Todd, Jr.

[57] ABSTRACT

An improved door structure and the method for forming such structure is disclosed. Individual rectangular door panels are formed from glass fiber reinforced plastic with a lip along at least one exterior edge for abutting a surface against which the door panel seals when the door is closed. A seal is attached to the door panel adjacent the lip for resiliently engaging the abutting surface. Internal wood and prestressed steel reinforcement strips extend along at least the long sides of the door panels to prevent the door panels from twisting or sagging. The interior of the door panel is reinforced with a honeycomb formed from a resin impregnated corrugated cardboard. Voids in the honeycomb may be filled with solid or particulate insulation.

15 Claims, 9 Drawing Figures

DOOR STRUCTURE AND METHOD FOR FORMING SUCH STRUCTURE

BACKGROUND OF THE INVENTION

This invention relates to a door structure and a method for forming such structure and more particularly to an improved door structure suitable for use as garage door panels.

In the past, garage doors have been manufactured from various materials including steel, glass fiber reinforced plastic and wood products. A typical garage door includes a plurality of elongated rectangular door panels which are attached to a track by means of rollers for opening and closing in a vertical direction. The panels extend the width of the door, for example, sixteen feet for a two car garage, are each one to two feet high and are generally one to two inches in thickness. Steel door panels may have only a single thickness of metal with a reinforcement frame extending around the periphery of each panel. Glass fiber reinforced plastic panels were commonly formed of a single thickness of plastic having horizontally extending corrugations for strength. Wooden doors have been constructed from either individual boards or from a hardboard such as Masonite laminated to both sides of a hollow wooden frame. In recent times, the hollow hardboard door construction has been most popular for new home construction. However, several problems are inherent in this type of door. Since garage doors are exposed to the weather, moisture can eventually penetrate the door panels and cause the hardboard to delaminate. Furthermore, the door panels for larger doors tend to sag or warp under the weight of the panel. This requires the addition of steel reinforcement channels along the back of each panel. However, the reinforcement channels in turn add to the cost of the door panels and further increase the total weight of the door which in turn requires heavier hardware, such as heavier counterbalance springs and heavier tracks for mounting the door. Furthermore, the door panels do not lend themselves to decoration without requiring additional labor during manufacture. Still another problem exists in prior art hardboard door panels in obtaining a weathertight seal between adjacent panels when the door is closed. The seal must be of a design which permits the panels to separate with respect to one another as the door is opened. Typical prior art hardboard door panels incorporate a shiplap type construction to form a weather seal.

Doors have been manufactured with a molded covering, such as a molded polyurethane, over a honeycomb core. Such a door structure is shown, for example, in U.S. Pat. No. 3,753,843 which issued Aug. 11, 1973. However, this construction has lacked the rigidity required for long garage door panels. When such panels were used in garage doors, the panels would sag, particularly when the door was left in a raised position with the panels extending horizontally. Twisting and sag detracted from the appearance of the door and prevented forming an acceptable seal between adjacent panels and between the panels and a door frame when the door was closed. Twisting is particularly bad in cold climates where the two sides of a door are subjected to a large temperature differential.

SUMMARY OF THE INVENTION

According to the present invention, an improved door structure and method for forming the door structure is provided for use in garage doors and other door panels. Flat rectangular door panels are molded from a glass fiber reinforced plastic such as a polyester. One or both surfaces of the flat door panels may be molded with either a raised or a depressed design, such as a simulated wood grain design. The door panels are formed with a lip extending along at least one exterior edge for abutting a surface against which the door panel seals when the door is closed, such as a corresponding edge on an abutting door panel. A rubber seal is attached to the door adjacent the lip for resiliently engaging the abutting surface. Each door panel is provided with an internal prestressed wooden frame around its periphery and internal prestressed steel reinforcement strips extend along at least the two long edges of the door panel to prevent the door panel from twisting or sagging during use. The interior of the door panel is reinforced with a honeycomb structure formed from a resin impregnated corrugated cardboard, such as a Bakelite impregnated corrugated cardboard.

If desired, the door panel is insulated by at least partially filling the voids in the honeycomb. The voids may be filled with a particulate material such as vermiculite or Styrofoam beads. Or, the honeycomb can be filled with a foamed synthetic resin. In one embodiment, the rigid honeycomb is used as a die to cut a hardened foam resin board, such as a board formed from Styrofoam. In a second embodiment, an uncured foamed resin is poured into a tray and the honeycomb is inserted into the tray such that the resin flows into the voids in the honeycomb. The resin is then allowed to harden. After hardening, a wire brush is used to expose the lower edges of the impregnated cardboard to permit bonding between the cardboard and the glass fiber reinforced plastic forming the walls or surfaces of the door panels. Translucent windows can be formed in the door by leaving voids in the insulation and the corrugated cardboard at the desired window location.

The above described embodiments of the door structure are stronger than and may weigh as little as one half or less than the weight of a comparable hardboard door panel. Furthermore, the door panels are not subject to moisture damage, such as delamination which occurs in hardboard doors.

Accordingly, it is an object of the invention to provide an improved door panel structure and a method for manufacturing such structure.

Another object of the invention is to provide an improved seal construction for between adjacent horizontal panels on a garage door.

Still another object of the invention is to provide an improved reinforced door structure which can be insulated.

Other objects and advantages of the invention will become apparent from the following detailed description, with reference being made to the accompanying drawings.

DESCRIPTION OF THE PREFERRED EMBODIMENTS

Figure 1:
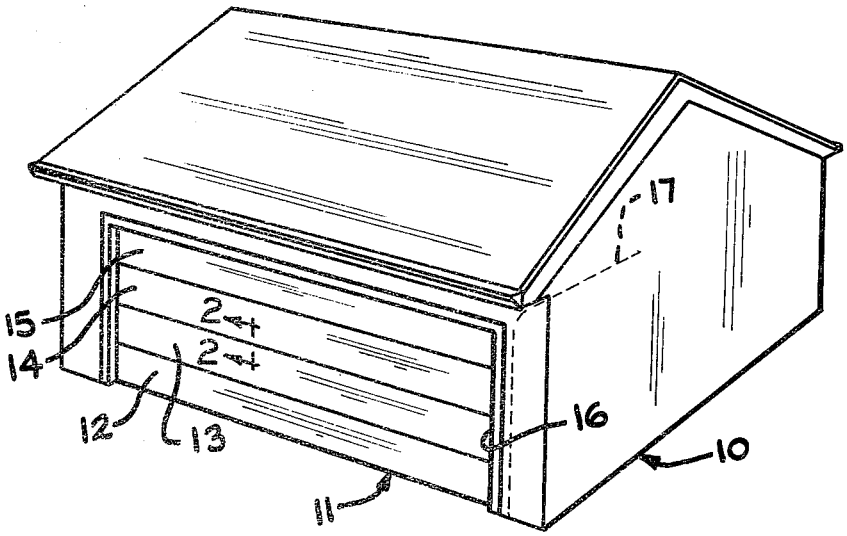
FIG. 1 is a perspective view of a garage having a vertically openable door formed from a plurality of elongated horizontal door panels.

Turning now to the drawings and particularly to FIG. 1, a pictorial view is shown of a garage 10 having a door 11 constructed in accordance with the present invention. The door 11 includes four rectangular panels 12-15, although it can include greater or fewer panels. Each of the panels 12-15 has a length extending across a door opening 16 for the garage 10, for example, sixteen feet for a two car garage. Typically, the panels 12-15 are from one to two feet high and from one to two inches in thickness. The door panels 12-15 are mounted to move on a track (not shown) along a path represented by the dashed line 17 when the door 11 is raised or lowered. The track and rollers attaching the door 11 to the track are of a conventional design and will not be discussed in detail herein.

Figure 2:
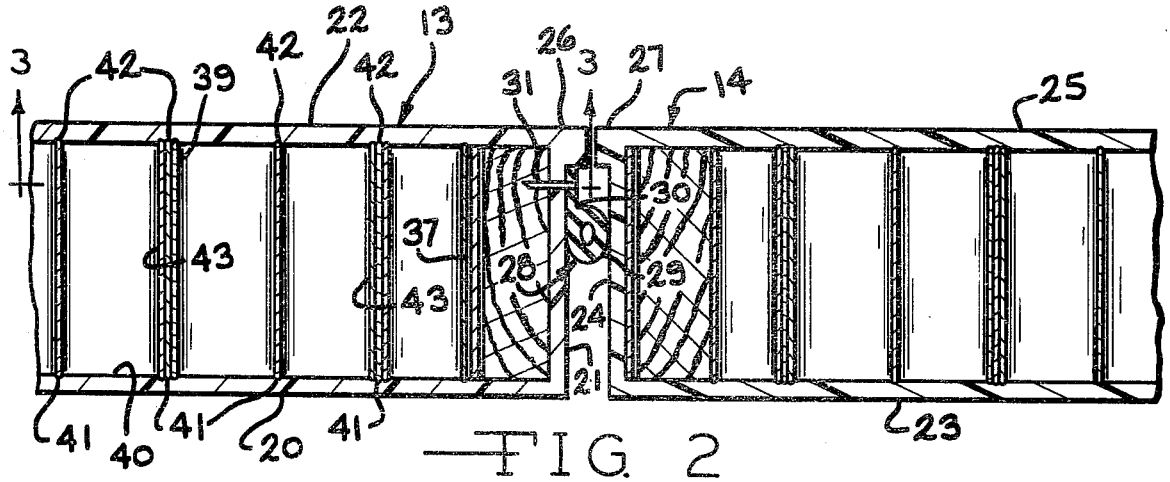
FIG. 2 is a fragmentary cross sectional view taken along line 2—2 of FIG. 1.
Figure 3:
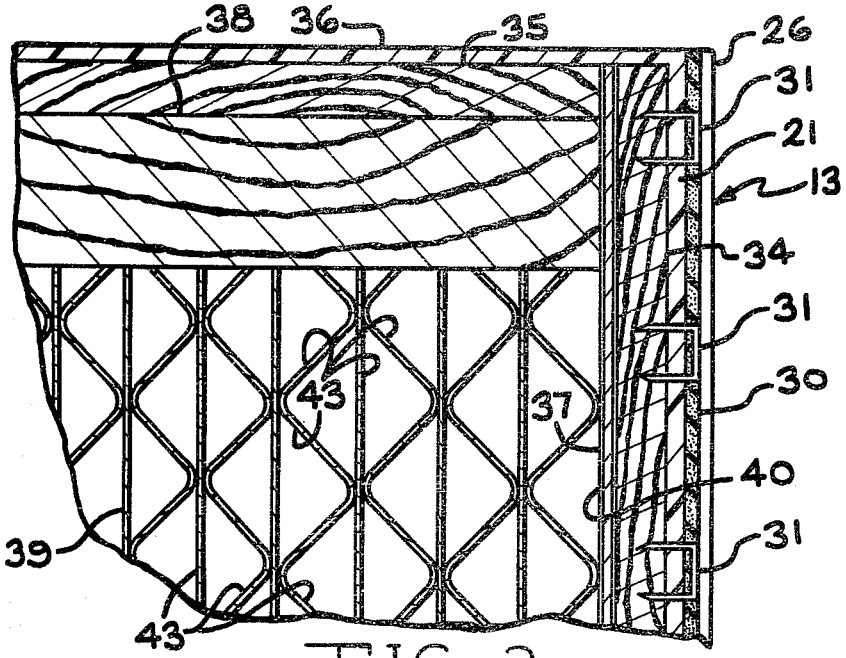
FIG. 3 is a fragmentary cross sectional view taken along line 3—3 of FIG. 2.

Turning now to FIGS. 2 and 3, fragmentary sections are shown through the two abutting door panels 13 and 14. The door panel 13 has an inner surface 20, an edge surface 21 which abuts the panel 14 and an outer surface 22 molded from a glass fiber reinforced synthetic resinous material, such as a glass fiber reinforced polyester. Similarly, the door panel 14 has molded surfaces including an inner surface 23, an edge surface 24 which abuts the panel 13 and an outer surface 25. The exterior surfaces of each of the panels 12-15 are formed entirely from a synthetic resinous material to form a completely weathertight structure. A lip 26 is molded integrally with and projects from the edge surface 21 of the panel 13 adjacent and along the exterior surface 22 for abutting a corresponding lip 27 on the panel 14 when the door 11 is in a closed position, as shown in FIG. 1. When the door 11 is closed, the lips 26 and 27 form a fairly tight weather seal between the panels 13 and 14. The weather seal between the panels 13 and 14 is completed by means of a gasket 28 attached to the panel 13. The gasket 28 is extruded from a suitable resilient plastic or rubber material and has a tubular portion 29 which resiliently engages the edge surface 24 on the panel 14. The gasket 28 also includes a strip 30 which extends along the length of the tubular portion 29 and is connected to the edge surface 21 on the panel 13 by means of staples 31 or other suitable fasteners. When the door 11 is closed, the gasket 28 is compressed between the adjacent edge surfaces 21 and 24 of the door panels 13 and 14 to form a weathertight seal. It should be noted that a similar seal construction is provided between the door panels 12 and 13 and between the door panels 14 and 15. In each case, the single gasket between each two abutting door panels may be attached to either of the panels.

A wooden frame is provided within and extends around the periphery of each door panel. Referring to the fragmentary sectional view of FIG. 3, a relatively narrow strip of wood 34 extends along the edge surface 21 of the door panel 13 and a second narrow strip 35 of wood extends along an end surface 36 of the door panel 13. The wooden strips 34 and 35 may be formed, for example, from plywood and may have a thickness on the order of 3/8 inch to 1/2 inch. The wooden strips 34 and 35 are each bonded to their adjacent edge surfaces 21 and 36, respectively, and also bonded to the interior surface 20 and the exterior surface 22 of the panel 13. The gasket staples 31 extend into the wood strip 34. A flat steel reinforcement strip 37 is encapsulated in a thin coating of the polyester resin from which the door panel 13 is formed and is bonded to the wood strip 34 along the entire length of the panel 13. The synthetic resin from which the door panel surfaces are molded forms a mild mechanical bond to the steel strip 37 and also entraps the steel strip 37 to increase its effectiveness in strengthening the door panel 13. Preferably, the steel strip 37 has rough surfaces for increasing the bond between the strip 37 and the resin. The roughness can be produced, for example, by knurling or by corrosion. When the panel edge does not include a gasket or other attachment to the wood frame, the steel strip can be placed between the wood frame and the molded door edge, as shown for the edge 24 of the panel 14 in FIG. 2. In either case, the steel strips and the wood frame are prestressed by shrinkage of the resin during curing. The steel strips are highly prestressed, for example, at 40,000 psi. The prestressed steel strip 37 greatly increases the strength and resistance of the door panel 13 to twisting and sagging without adding significantly to the weight of the door panel 13. When the door 11 is raised so that the surfaces 20 and 22 of the door panel 13 extend horizontally, there is a strong tendency for the door panel 13 to sag, since the door panel may be sixteen feet or more in length and is supported only at its ends. However, the steel strip 37 extends edgewise or parallel to the edge surface 21 in the horizontal panel and prevents the panel 13 from sagging. More importantly, these sagging forces are small when compared to the prestressing forces on the steel strips. When the door 11 is closed and subjected to extreme temperature differentials between the interior surface 20 and the exterior surface 22, there is also a tendency for the door panels to warp. For example, the interior of the garage 10 may reach a temperature on the order of 40° F. to 60° F. when a heated car is parked in the garage 10 while at the same time the exterior of the door 11 may be subjected to subzero temperatures in the northern hemisphere. This temperature differential can cause considerable distortion both in wooden door structures and in unreinforced plastic door structures. However, the prestressed steel strips 37 which extend along each long edge surface of the door panel 13 restrain and prevent the door panels from twisting, bowing or warping since thermal stresses in the door are also small as compared to the prestressing in the steel strips.

In addition to the wood strip 35 which extends along the end surface 36, a second and wider wood strip 38 is mounted interior from the end wood strip 35. The strip 38 is preferably coated with the synthetic resinous material from which the surface 36 is formed in order to bond the strip 38 to the wood strip 35 and also to the interior surface 20 and the exterior surface 22 of the door panel 13. The wood strip 38 along each end of the door panel 13 provides strong surface to which are attached hardware including the rollers used to mount the panel 13 in the garage 10. By providing the wood strips 38, the hardware is attached to the door panel 13 with conventional wood screws and bolts.

A rigid honeycomb core 39 fills an interior chamber 40 within the door panel 13. The chamber 40 is defined by either the steel strip 37, or the wood strip 34 when the steel strip 37 is positioned between the wood strip 34 and the edge 21, extending along the elongated sides and the wood strips 38 extending along the shorter sides of the panel 13. The core 39 is preferably formed from corrugated cardboard which is impregnated with a resin, such as Bakelite. Edges 41 of the core 39 are embedded in the interior surface 20 of the panel 13 and edges 42 of the core 39 are embedded within the exterior surface 22 to greatly increase the strength of the panel 13. The core 39 strengthens the door panel 13 without greatly increasing its weight since a major portion of the core 39 comprises voids 43. The voids 43 also to a limited extent, insulate the door panel 13 since they form dead air spaces. However, the door panel 13 can be further insulated by at least partially filling the voids 43 with either a solid or a particulate insulation material.

Figure 4:
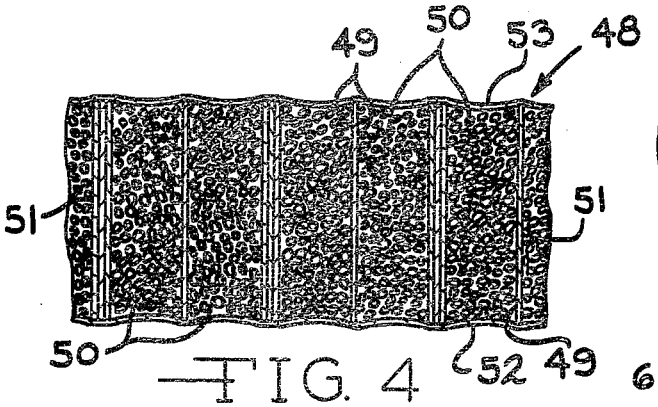
FIG. 4 is a fragmentary cross sectional view showing one embodiment of an insulated honeycomb core for use in the door structure of FIGS. 1-3.

Referring now to FIG. 4, a honeycomb core structure 48 is shown having voids 49 filled with a particulate insulating material 50. The insulating material 50 may be any type of low density insulation, such as vermiculite or expanded polystyrene beads. The honeycomb core structure 48 includes a main core member 51 which defines the voids 49. The core member 51 is formed from a rigid material, such as a Bakelite or other resin impregnated cardboard. The lower ends of the voids 49 are enclosed by means of a thin sheet of tissue paper 52 which is impregnated with the same resinous material from which the outer surfaces of the door panels are formed, such as a polyester. After the voids 49 are filled with the particulate insulating material 50, the upper ends of the voids 49 are also enclosed with a thin sheet of resin impregnated tissue paper 53. The resin impregnating the tissue papers 52 and 53 bond the tissue papers 52 and 53 to the core member 51. The core 48 which includes the insulation 50 is then used during the construction of a door panel in place of the honeycomb core 39 shown for the door panel 13 in FIGS. 2 and 3.

An insulated core structure 56 can also be formed with voids 57 in a honeycomb core 58 at least partially filled with a solid insulating material 59. The insulating material 59 may, for example, comprise a foamed urethane or a hardened expanded polystyrene. In the embodiment first in FIG. 5, the core structure 56 is formed forst by filling a tray with a desired foamed resin up to a predetermined level. The honeycomb core 58 is then set in the tray so that the foamed resin flows into the voids 57. The foamed resin is then allowed to harden into the insulating material 59. After the foamed resin has hardened into the insulating material 59, a bottom surface 60 is partially removed with a wire brush or other suitable means to expose lower ends 61 of the honeycomb core 58. This allows the lower ends 61 to be embedded into and bond to the surface of the door panel in which the core structure 56 is used, just as the ends 41 and 42 are embedded in the surfaces 20 and 22 of the door panel 13, as shown in FIG. 2. This greatly increases the strength of the bond between the core structure 56 and the surfaces of the door panel since the polyester or other material from which the surfaces are formed will not form a strong bond with the insulating material 59.

Figure 5:
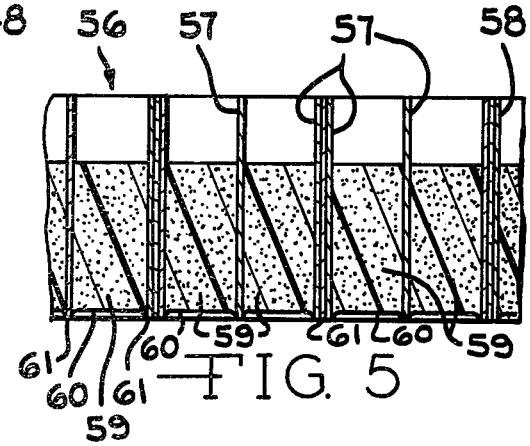
FIG. 5 is a fragmentary cross sectional view of a second embodiment of an insulated honeycomb core for use in the door structure shown in FIGS. 1-3.
Figure 6:
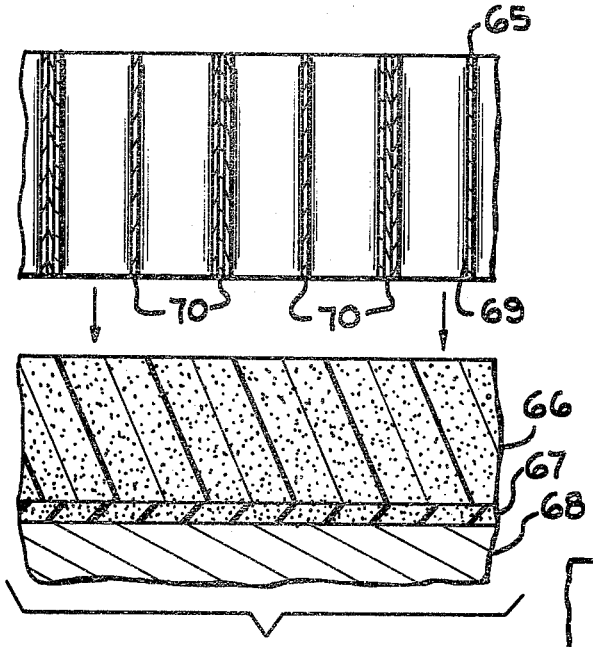
FIG. 6 is a pictorial view illustrating one method for forming the insulated core of FIG. 5.

Another method for forming a core structure similar to the core structure 56 is shown in FIG. 5. Here, a Bakelite or other resin impregnated honeycomb core 65 is used as a die to cut a solid block of expanded resin insulating material 66. The insulating material 66 is placed on a thin sheet of sponge rubber or other resilient material 67 which rests on a platen 68. The honeycomb core 65 is then forced through the insulating material 66 against the sponge rubber 67 and platen 68. The honeycomb core 65 is provided with sufficient rigidity due to the impregnating resin to cut through the insulating material 66. The insulating material 66 is then forced into voids 69 in the honeycomb core 65. The sponge rubber 67 on the platen 68 forces the insulating material 66 into the voids 69 slightly past the lower ends 70 of the honeycomb core 65. This allows the lower ends 70 to project slightly past the insulation 66 for bonding to the surface of the panel in which the insulated honeycomb core 65 is used.

Figure 7:
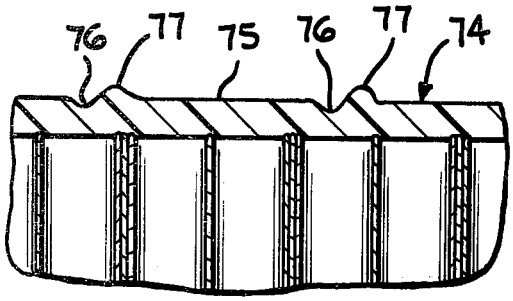
FIG. 7 is a fragmentary cross sectional view showing surface decorations in a door structure manufactured in accordance with one embodiment of the invention.

The door panels 12–15 shown on the garage 10 of FIG. 1 are provided with flat exterior surfaces. However, it should be noted that either the exterior surfaces or the interior surfaces of the door panels may be molded with a desired design or pattern. Referring to FIG. 7, a fragmentary portion of a door panel 74 is shown. The door panel 74 has an exterior surface 75 which is molded from a polyester or similar material. A pattern in the form of depressions 76 and ridges 77 is molded in all the surface 75 of the door panel 74. The pattern may be in any desired form, such as a simulated wood grain, and may be entirely raised or entirely depressed below the normal exterior surface of the panel 74. Furthermore, decorative patterns may be molded in both the exterior surface and the interior surface of the door panels, when desired. The techniques used for molding the patterns in the door panel surfaces are well known in the prior art.

Figure 8:
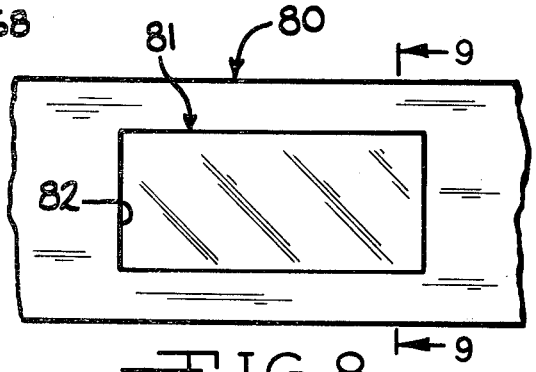
FIG. 8 is a fragmentary side view of a door panel manufactured in accordance with one embodiment of the invention and having a translucent window formed integrally therein.
Figure 9:
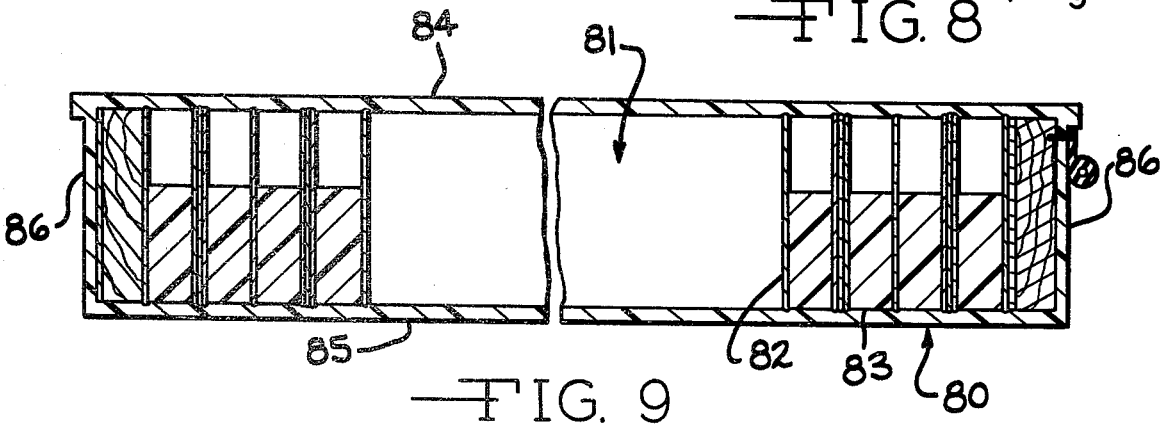
FIG. 9 is a cross sectional view taken along line 9—9 of FIG. 8.

Turning now to FIGS. 8 and 9, a door panel 80 is shown in accordance with a modified embodiment of the invention. The door panel 80 is provided with a translucent window 81 defined by an opening 82 in an insulated honeycomb core 83. The door panel 80 has an exterior surface 84, an interior surface 85 and edge surfaces 86 molded from a glass fiber reinforced resin such as a polyester. The surfaces 84 and 85 are translucent. Exterior light passes through the surface 84, the opening 82 in the core 83 and the interior surface 85. Since the surfaces 84 and 85 are not completely transparent, the window 81 will pass light while providing some degree of security. At locations in the door panel other than the opening 82, the core 83 prevents light from passing through the door panel 80. If desired, the exterior surface 84 may be molded with an integral frame (not shown) surrounding the window 81. Also, all surfaces of the door panel 80, except for the window 81, can be painted or otherwise decorated.

It will be appreciated that various modifications and changes may be made in the above-described door panels without departing from the spirit and the scope of the invention. For example, a one piece building entrance door may be formed with a honeycomb core, steel reinforcement strips and a wood frame encased in a shell formed from glass reinforced polyester or other resins. The structure provides a dimensionally stable door unlike prior art doors having a honeycomb core and a molded exterior surface. Where necessary, the steel strip can be interrupted and a wood insert can be placed in the gap for attachment of hinges to the long edges of the door.

What I claim is:

1. An improved flat rectangular door panel having two side surfaces, two long edge surfaces and two short edge surfaces comprising a flat rectangular honeycomb core having two long edges and two short edges, two flat steel strips extending perpendicular to said side surfaces, one of said strips abutting each long edge on said core, a wood frame enclosing said core, said wood frame abutting said steel strips and said short core edges, and a molded synthetic resinous material defining said panel surfaces and bonded to said wood frame, said steel strips and said honeycomb core, said molded synthetic resinous material stressing said steel strips.

2. An improved door panel, as set forth in claim 1, and wherein said synthetic resinous material encapsulates said wood frame and said steel strips.

3. An improved door panel, as set forth in claim 2, wherein said steel strips are positioned between said wood frame and said long edges.

4. An improved door panel, as set forth in claim 2, wherein said steel strips are positioned between said wood frame and said core.

5. An improved door panel, as set forth in claim 2, wherein said honeycomb core is formed from a resin impregnated cardboard, wherein said honeycomb core includes a plurality of voids extending between said side surfaces, and further including insulation means at least partially filling said core voids for insulating said door panel.

6. An improved door panel, as set forth in claim 5, wherein said insulation means comprises a low density particulate insulating material.

7. An improved door panel, as set forth in claim 5, wherein said insulation means comprises a hardened foamed synthetic resinous material.

8. An improved door panel, as set forth in claim 7, wherein said insulation means is bonded to said honeycomb core.

9. An improved door panel, as set forth in claim 5, wherein said synthetic resinous material is translucent, and wherein said honeycomb core and said insulation means has a void forming a translucent window between said panel side surfaces.

10. A method for forming a flat rectangular door panel having two side surfaces, two long edge surfaces and two short edge surfaces comprising the steps of: positioning flat steel strips and flat wood strips coated with a synthetic resinous material along at least the long edges of a flat rectangular honeycomb core having two long edges and two short edges; placing wood strips coated with said synthetic resinous material along said short core edges, and molding said panel surfaces over said core and strips from said synthetic resinous material, said synthetic resinous material encapsulating and bonding together said core, said steel strips and said wood strips.

11. A method for forming a flat rectangular door panel, as set forth in claim 10, and further including the step of at least partially filling voids in said honeycomb core with a low density insulation.

12. A method for forming a flat rectangular door panel, as set forth in claim 11, wherein said voids in said core are filled by die cutting a sheet of a hardened foamed synthetic resinous insulation material with said honeycomb core prior to placing said steel strips against said core.

13. A method for forming a flat rectangular door panel, as set forth in claim 11, wherein said voids in said core are filled by inserting one side of said core in a pool of uncured foamed synthetic resinous insulation material, said uncured resinous material flowing into said voids, curing said resinous material, and removing a layer of said cured synthetic resinous insulation material from said one side of said core whereby said one side of said core is exposed for bonding to said molded panel surfaces.

14. A method for forming a flat rectangular door panel, as set forth in claim 10, wherein at least one of said flat steel strips is positioned between one of said flat wood strips and one of the long edges of said core.

15. A method for forming a flat rectangular door panel, as set forth in claim 10, wherein at least one of said flat wood strips is positioned between one of said flat steel strips and one of the long edges of said core.

* * * * *